US005207621A

United States Patent [19]

Koch et al.

[11] Patent Number: 5,207,621

[45] Date of Patent: May 4, 1993

[54] STAIR CLIMBING EXERCISE MACHINE

[75] Inventors: Steven L. Koch, Encinitas; William Kousens, Santee, both of Calif.

[73] Assignee: Integral Products, Las Vegas, Nev.

[21] Appl. No.: 652,013

[22] Filed: Feb. 7, 1991

[51] Int. Cl.[5] ..... A63B 22/04; A63B 23/04; A63B 21/008

[52] U.S. Cl. ..... 482/53; 482/6; 482/52; 482/112; 482/113; 482/902; 128/25 B

[58] Field of Search ..... 482/1, 4–8, 482/51, 52, 53, 54, 57, 112, 113, 900, 901, 902; 434/247, 255, 392; 73/379; 128/25 R, 25 B

[56] References Cited

U.S. PATENT DOCUMENTS

| | | | |
|---|---|---|---|
| 3,529,474 | 9/1970 | Olson et al. | 482/113 X |
| 3,592,466 | 7/1971 | Parsons | 482/53 |
| 3,747,924 | 7/1973 | Champoux | 482/52 |
| 3,970,302 | 7/1976 | McFee | 482/53 |
| 4,378,111 | 3/1983 | Tsuchida et al. | 482/54 X |
| 4,496,147 | 1/1985 | DeCloux et al. | 482/53 |
| 4,512,566 | 4/1985 | Bicocchi | 482/2 |
| 4,555,108 | 11/1985 | Monteiro | 482/53 |
| 4,563,001 | 1/1986 | Terauds | 482/53 |
| 4,600,187 | 7/1986 | Schenker | 482/52 |
| 4,659,075 | 4/1987 | Wilkinson | 482/52 |
| 4,676,501 | 6/1987 | Hoagland et al. | 482/51 |
| 4,681,316 | 7/1987 | DeCloux et al. | 482/113 |
| 4,708,338 | 11/1987 | Potts | 482/52 |
| 4,720,093 | 1/1988 | Del Mar | 482/52 |
| 4,919,416 | 4/1990 | DeCloux | 482/53 |
| 4,927,136 | 5/1990 | Leask | 482/52 |
| 4,989,858 | 2/1991 | Young et al. | 482/53 |
| 5,026,046 | 6/1991 | DeCloux | 482/53 |
| 5,114,389 | 5/1992 | Brentham | 482/113 X |

FOREIGN PATENT DOCUMENTS 2114901 9/1983 United Kingdom .

*Primary Examiner*—Richard J. Apley
*Assistant Examiner*—Joe H. Cheng
*Attorney, Agent, or Firm*—Brown, Martin, Haller & McClain

[57] ABSTRACT

A stair climbing exercise machine comprises an upright frame and a pair of reciprocating left and right pedals pivotally mounted on the frame for independent movement between raised and lowered positions. A hydraulic control system is connected to the pedals to provide resistance to downward movement and to return each lowered pedal to a raised position independent of operation of the other pedal. In a preferred embodiment, a TV screen is mounted on the frame and is controlled by a computer to display certain information during an exercise routine, which may be overlaid on a TV program. The computer may also control the duration and difficulty of each exercise routine.

13 Claims, 4 Drawing Sheets

STAIR CLIMBING EXERCISE MACHINE

BACKGROUND OF THE INVENTION

1. Field of the Invention

The present invention relates generally to exercise machines for use indoors and is particularly concerned with an exercise machine for simulating stair climbing.

2. Description of Related Art

Exercise machines which simulate stair climbing types of exercise are relatively well known in the exercising field. For example, U.S. Pat. No. 4,708,338 of Potts describes such an apparatus in which right and left pedals are pivotally mounted on a frame. The user depresses alternate pedals against the action of a spring in a fashion similar to that used in climbing stairs. A monitoring system monitors the work performed by the user and displays that information on a screen mounted at an appropriate height on the frame, in the form of an LED graphical display. Other stair climbing exercise machines are described in U.S. Pat. Nos. 4,496,147 of DeCloux, et al., 4,676,501 of Hoagland, et al., and 3,970,302 of McFee.

SUMMARY OF THE INVENTION

It is an object of the present invention to provide a new and improved stair climbing exercise machine.

According to the present invention, a stair climbing exercise machine is provided, which comprises an upright frame, a pair of right and left pedals pivotally mounted on the frame for independent movement between raised and lowered positions, and a hydraulic control assembly for resisting downward movement of each pedal independent of movement of the other pedal and for returning each lowered pedal to a raised position on removal of weight from that pedal.

Thus, the system of this invention more accurately mimics true stair climbing since one pedal can be pushed down without simultaneously urging the other pedal up. Pedal operation is therefore independent. Lowered pedals are urged upwardly only on removal of weight from the respective pedal, as a person would naturally do when climbing stairs.

The hydraulic control assembly in the preferred embodiment of the invention comprises a pair of hydraulic piston and cylinder actuators each linked to a respective one of the pedals and connected in a hydraulic control circuit for controlling the pedal operation in the desired fashion. Preferably, each hydraulic actuator is linked at one end to the frame and at the opposite end to a respective one of the pedals, so that the actuator will be extended and retracted on movement of the pedal in opposite directions. Pressure in the hydraulic circuit will act to resist downward movement of the pedal. The hydraulic circuit includes a gas pressurized reservoir to which each hydraulic actuator cylinder is linked via a one-way valve and a flow control valve, so that operation of one actuator will have no effect on the other actuator. A return path from the reservoir to the cylinder is provided via another one-way valve. The flow control valve will control the pedal speed, and thus the speed of climbing or the pedal rate, and hence controls the effort expended.

Preferably, a control system is provided for controlling and monitoring each exercise routine according to information provided by the user as well as stored data. The control system includes a computer programmed with exercise routines of varying length and difficulty, a data entry device linked to the computer for user entry of various commands and information such as their age, weight and so on, a video display unit for displaying information on the progress of an exercise routine to the user, and various sensors for monitoring operation of the machine and providing sensed information to the computer for use in controlling the routine and displaying predetermined sequences of information.

Preferably, the sensors include a sensor for monitoring the user's heart or pulse rate as well as sensors for detecting the distance through which the pedals are moved.

The video display unit may be in the form of a TV screen so that the person using the machine has the option of watching standard television programming with the exercise monitoring information overlaid on the screen, or of watching just the monitoring information, which may be simply an alpha-numerical display or may be in the form of a cartoon generated by the computer to mimic the effort expended by the user.

Due to its hydraulic operation, this stair climbing exercise machine is both quiet and reliable. The independent pedal operation mimics standard stair climbing more accurately than dependent pedal operated machines.

BRIEF DESCRIPTION OF THE DRAWINGS

The present invention will be better understood from the following detailed description of a preferred embodiment, taken in conjunction with the accompanying drawings, in which like reference numerals refer to like parts, and in which.

DESCRIPTION OF THE PREFERRED EMBODIMENT

Figure 1:
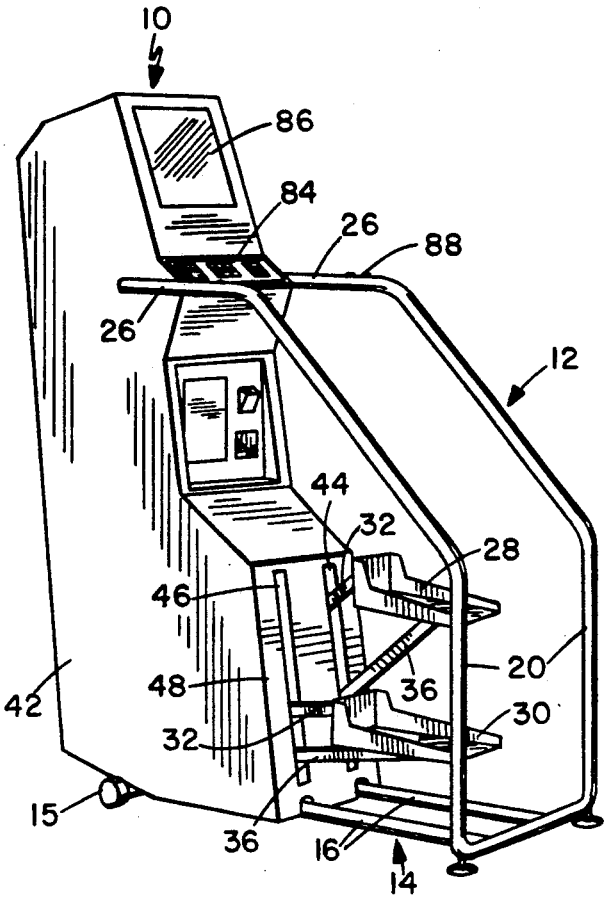
FIG. 1 is a perspective view of a configuration of the exercise machine according to a preferred embodiment of the invention.
Figure 3:
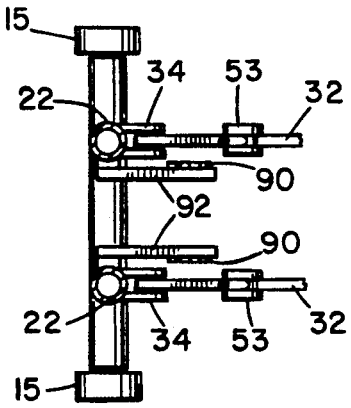
FIG. 3 is a sectional view taken on line 3—3 of FIG. 2.
Figure 2:
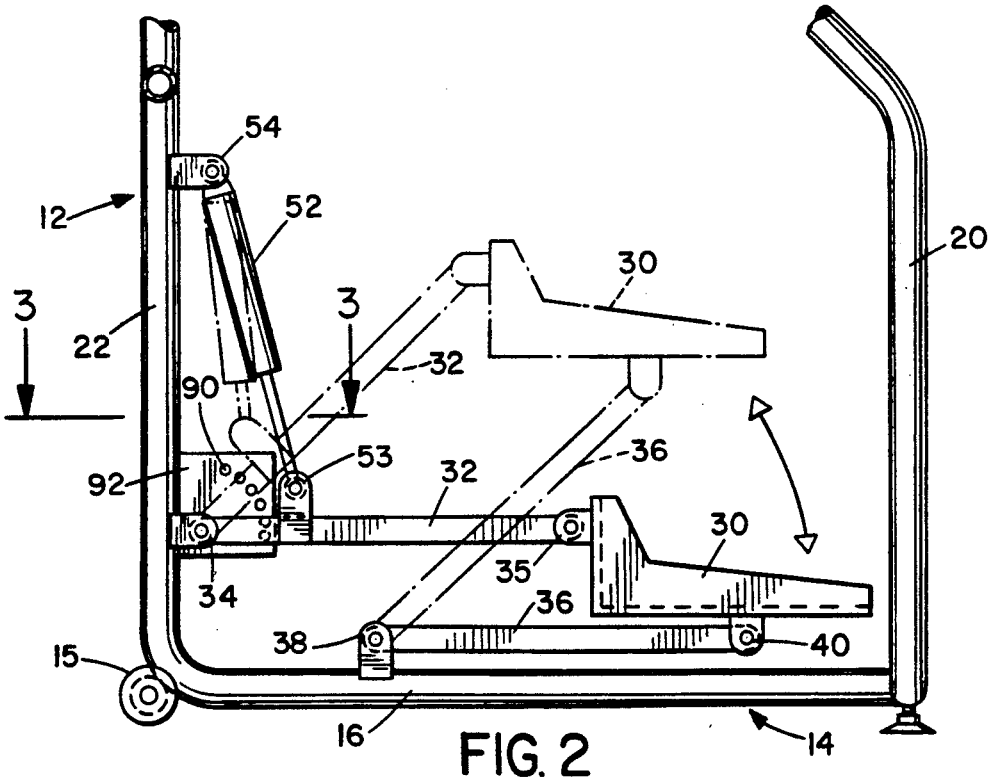
FIG. 2 is a side elevation view of the internal structure illustrating the pedal action.
Figure 4:
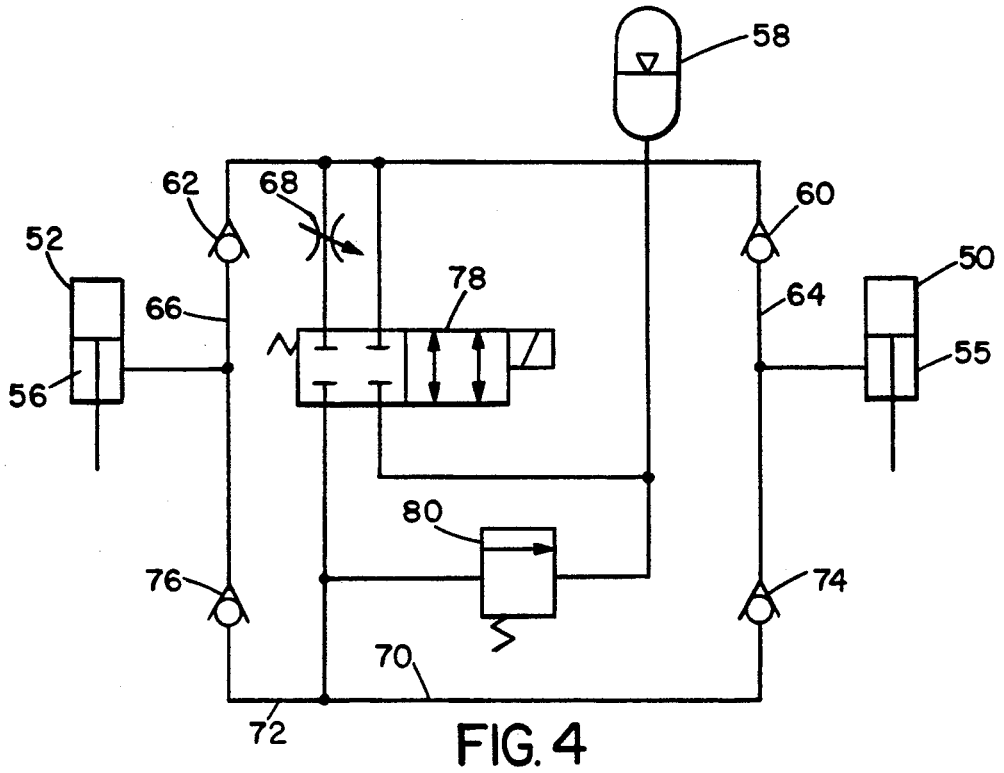
FIG. 4 is a diagram of a hydraulic system for controlling the pedals of the machine.
Figure 5:
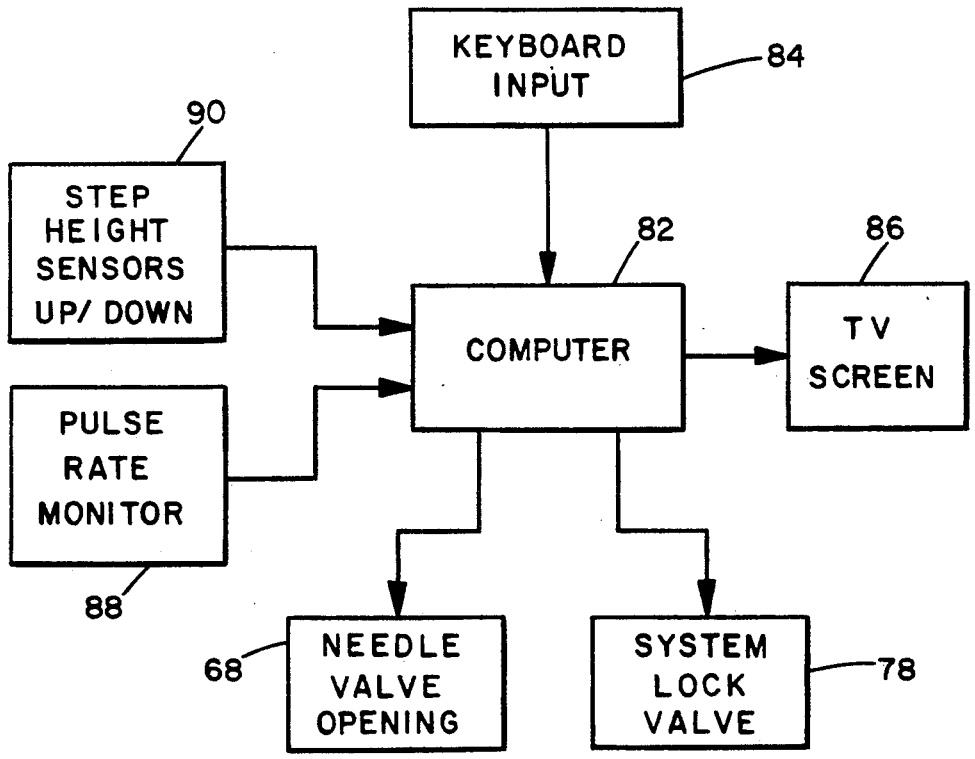
FIG. 5 is a block diagram of the control system of the machine.
Figure 6:
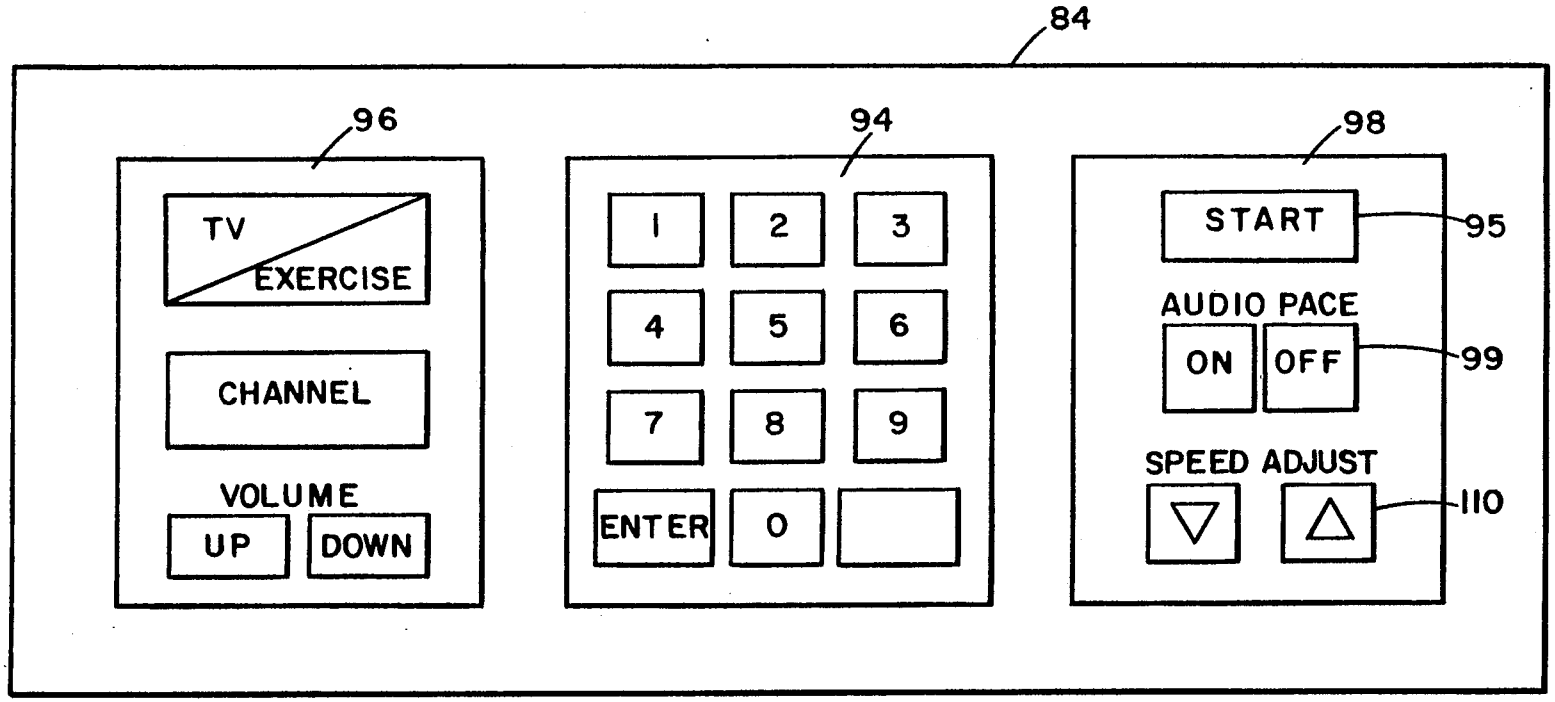
FIG. 6 is a front elevational view of the control panel.

FIGS. 1 to 3 of the drawings illustrate the structure of a stair climbing exercise machine 10 according to a preferred embodiment of the present invention, while FIGS. 4 to 6 illustrate the control system for controlling and monitoring operation of the machine.

As best illustrated in FIGS. 1 to 3, the machine is constructed from an upright tubular support frame 12 having a base 14 comprising spaced parallel tubes or rods 16, spaced sides defined by upright parallel front and rear tubes or rods 20, 22, the front tubes 20 being inclined towards the rear with horizontal upper members or rods 26 forming handle bars connecting the front rods to the upper ends of rear rods 22 (not visible in the drawings). Heavy duty castors 15 on the base permit the machine to be moved about easily without any need for heavy lifting, simply by lifting the front end of the machine and pushing. A pair of reciprocating right and left foot pedals 28, 30 are pivotally supported on the support frame for up and down movement via a parallelogram-like support linkage on each side of the frame designed to maintain the pedals horizontally as they are moved up and down, as best illustrated in FIG. 2. Each support linkage includes a first, upper support arm 32 pivoted at one end 34 to the rear tube or rod 22 on that side and pivoted at the opposite end 35 to the forward end of the respective foot pedal 28, 30. A second, lower support arm 36 of the linkage is pivoted at one end 38 to the base rod 16 on that side of the frame and at the opposite end to a central position 40 on the undersurface of the respective foot pedal. With this arrangement, the arms 32 and 36 will remain parallel as the pedals move up and down and the pedals will be held horizontal, as indicated in FIG. 2.

Operation of the machine in an exercise routine is controlled and monitored by a control and monitoring system illustrated diagrammatically in FIG. 5, while a hydraulic system as illustrated in FIG. 4 controls pedal movement and provides resistance to downward movement of each pedal so that a user must expend effort in pushing the pedals down, similar to that used in lifting their weight when climbing stairs. The control and hydraulic systems are mounted at the forward end of the frame and enclosed in a suitable outer housing or enclosure 42, as best illustrated in FIG. 1. The housing 42 has a pair of spaced parallel, vertically extending slots 44, 46 on its front wall 48 through which the parallel linkage arms project and which allow the full range of desired pedal movement.

The hydraulic system will now be described in more detail with reference to FIG. 4. Basically, the upper arm 32 of each parallelogram linkage is pivotally secured to one end 53 of a hydraulic actuator 50, 52 respectively for independently controlling right and left pedal movement. The opposite end of each actuator is pivotally secured to the rear rod 22 on that side of the frame at a location 54 spaced above the lower arm 40 of the linkage. Each hydraulic actuator 50, 52 comprises a piston and cylinder or so-called hydraulic ram device, and the cylinder 54, 56 of each pedal is connected in a hydraulic circuit as illustrated in FIG. 4. The circuit comprises a pressurized reservoir 58 to which each actuator cylinder 55, 56 is connected along a first flow path 70, 72 respectively via one-way flow direction check valves 74, 76, and adjustable flow control valve 68. The reservoir is also connected to the cylinders along return paths 64, 66 via one-way check valves 60, 62.

With this hydraulic circuit, the pedal movement will be completely independent. In other words, pushing down on one pedal will not cause the other pedal to rise. When one pedal, say the left hand pedal 30, is pushed down, its attached actuator 52 will be extended as illustrated in solid outline in FIG. 2. Fluid will flow out of cylinder 56 and along flow path 72 through one-way check valve 76 and flow control valve 68 to the reservoir. Upward movement of the other pedal will be dependent on the weight on the pedal. If the user shifts their weight from the right hand pedal as the left is pushed down, as is the natural tendency in stair climbing, fluid will flow from the reservoir 58 along path 64 via one-way valve 60 to cylinder 54, urging the piston into the cylinder and retracting the actuator to the dotted line position illustrated in FIG. 2, so that the pedal is raised. The rate at which the pedal can be pushed down will depend on the size of the opening of valve 68, with a larger opening increasing the pedal speed.

Preferably, a solenoid operated system lock valve 78 is provided in the pathway from the cylinders to the reservoir, as illustrated in FIG. 4, to allow the system to be locked after each exercise routine of predetermined length. This may be used, for example, in conjunction with a coin slot for a user to enter a coin or token to use the machine. Detection of coin deposit will release valve 78, and the valve will be locked again after expiry of a predetermined exercise time.

Also provided in FIG. 5 is an optional pressure relief valve 80.

A control and monitoring system as basically illustrated in FIG. 5 is provided for monitoring use of the machine and for controlling operation according to the monitored data. The system includes a central processing unit or computer 82, which may be a PC type, with built-in memory for storing data and program instructions, a keyboard 84 for entering data and commands into the computer, and a video display screen 86, which is preferably a television screen, for displaying information and instructions to a user of the machine. A video cassette unit (not illustrated) may also be provided for connection to the TV screen.

Various sensors are provided for monitoring exercise routines, and the sensor outputs are connected to the computer where they are used according to program instructions for in generating various information and for providing various control functions, as explained in more detail below. The sensors include a pulse rate monitor 88, which is preferably located in the handle bars of the frame so that the user gripping the frame in the appropriate position can be monitored without having to attach a separate sensor to their body. The heart or pulse rate monitor detects the pulse rate from the palm of the user's hand as they grip the handle bar. A suitable heart rate monitor for use in this system is manufactured by Bio-Sig Instruments of Montreal, Canada, for example. A series of position or step height sensors 90 are also provided for monitoring pedal distance. The position sensors 90, which may comprise infrared detectors, for example, are mounted in an arc on sensor plate 92 adjacent one or both of the upper arms of the pedal support linkage, as illustrated in FIG. 2. A suitable light or infrared transmitter is positioned on the arm so that it will activate the respective sensors as it travels in an arc across them in moving up and down with the pedal. Preferably, where the maximum pedal stroke is 14 inches, seven equally spaced sensors are provided along the pedal path with an eighth sensor at half the distance at the end of the path. The sensor outputs are monitored by the computer.

The computer is also connected to both the flow control valve 68 to control the size of the valve opening, which may be a needle-type valve, via a stepper motor (not illustrated), and to control actuation of the solenoid controlling opening and closing of the system lock valve 78, if present.

FIG. 1 illustrates the location of the video or TV screen and control panel on the front of the machine housing. The functions provided on the control panel or keyboard are illustrated in more detail in FIG. 6. A numerical key pad 94 is provided for the user to input statistical data such as age, height and weight. A video screen selector pad 96 allows the user to select TV station viewing or exercise display viewing, as explained in more detail below. A further set of control keys 98 allows the user to control the exercise routine. Keys 98 include a START button 95 for initiating an exercise routine, and an audio pace on/off switch 99 which allows the user to select whether or not to have the monitored information displayed on the screen continuously during the exercise routine. Additionally, speed adjustment keys 110 are provided to allow the user to increase or decrease the speed of the routine, via the flow control valve stepper motor, overriding the pace set by the computer according to the programmed instructions.

Operation of the machine to perform an exercise routine will now be described in more detail. The computer will be programmed with a series of different, pre-set exercise programs of varying lengths and difficulty. Different time periods may be provided, for example 6 minute, 12 minute, 18 minute and 24 minute routines at various different paces. The user must normally deposit a required coin or token into the machine to initiate a routine, where the machine is coin operated. When the machine is not in use, an informational display will be provided on the screen, indicating the options available, for example selection of a variety of preprogrammed exercise routines with varying degrees of difficulty or selection of manual mode. In the latter case, the pace is set by the user at controls 110, 112.

The system also enables the user to opt for a fitness level determination. In this case, the user is initially asked to enter data including their age, weight, height and sex. The computer uses this data in conjunction with pulse rate information generated during a preprogrammed routine to determine the user's fitness level for their age according to the target heart or pulse rate for that age group which is stored in tables in the computer's memory.

In normal operation of the system, the user can opt to watch broadcast TV on the TV screen while exercising, reducing the risk of boredom when exercising repetitively indoors. At the same time, information may be optionally displayed on the screen to enable the user to monitor their progress. This information is generated by the computer according to program instructions as well as data continuously received from the sensors, and overlaid on part of the TV screen in the usual manner. The information displayed includes time elapsed, pulse rate, calories burned and climb rate. The calories burned can be calculated according to input from the pedal height sensors and the weight of the user. The pedal height sensors determine the height climbed (single pedal stroke×2), and this is combined with the climber's weight to enable the oxygen uptake, and thus the calories burned, to be calculated.

Preferably, the computer is also programmed to generate a cartoon-like or graphical progress display, at the user's option, in a similar manner to that used in computer game generating programs. The display in a preferred embodiment of the invention comprises a tall building or structure which a stick figure representing the user climbs at a rate dependent on the input from the pedal height sensors. The computer is programmed such that the user will reach the top of the structure at the end of the exercise routine time if they climb at a pre-determined pace. Preferably, another figure, such as that of an ape or monkey, is simultaneously displayed climbing the opposite side of the building at a set pace according to the selected routine, so that the user "races" against the cartoon figure. The ape or monkey figure climbs at the pre-set rate according to the selected routine. If the user falls behind that pace, the figure representing the user on the screen will also fall behind, and a message such as "Push harder you are falling behind" is displayed on the screen. If the user gets ahead by more than a certain amount, such as 5 steps, a message such as "You are exceeding your programmed pace, adjust speed to slower." is displayed. If the user follows this instruction, the flow control valve opening will be reduced, reducing the pedal rate. The cartoon figure generation may be generated as an overlay on the TV picture if the user opts to watch a TV program or videocassette simultaneously.

Preferably, an audio signal representing the desired pace is also generated, which will become faster if the user is pedalling too slowly, for example. This may be turned on or off by the user as desired.

Figure 7:
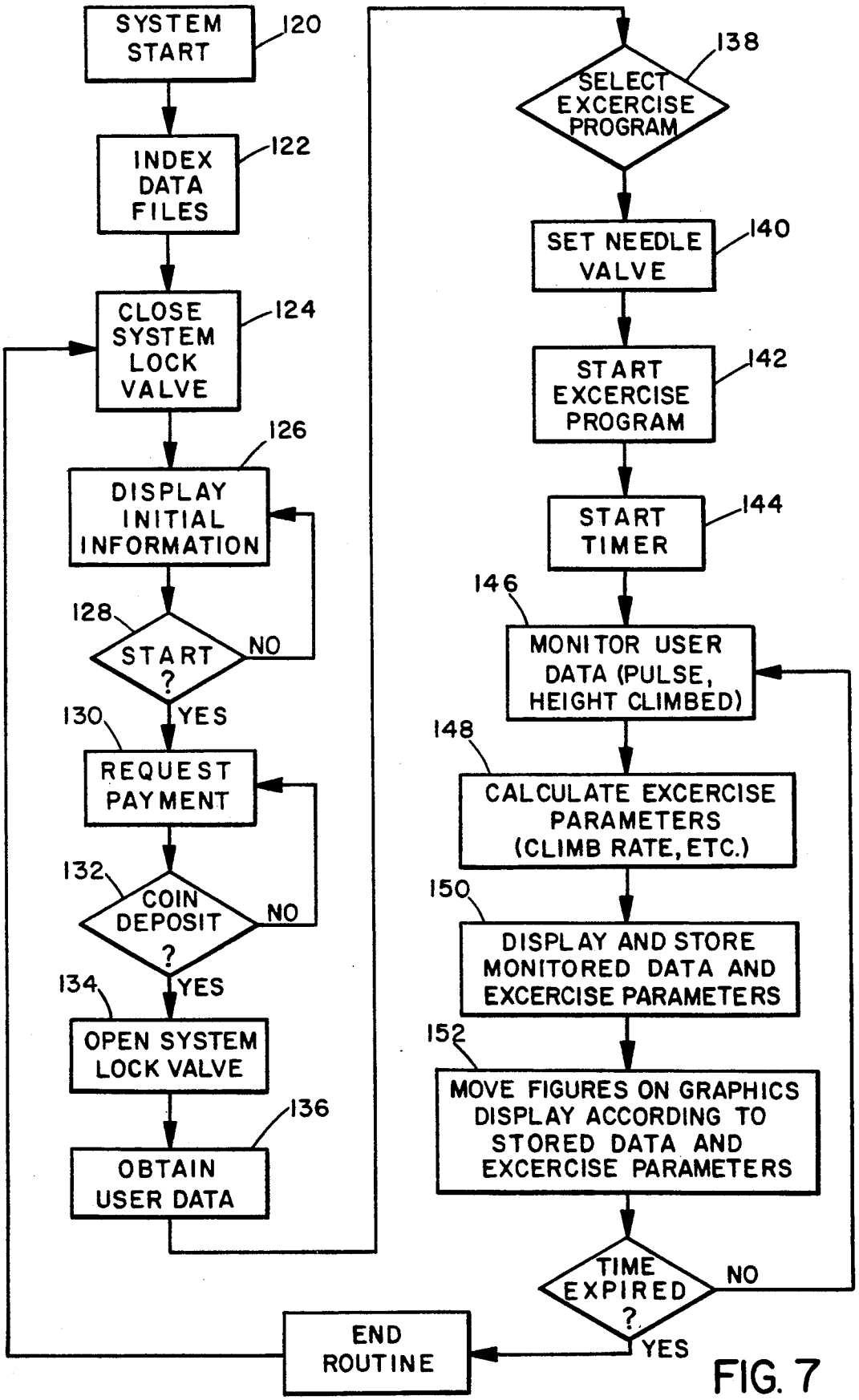
FIG. 7 is a flow diagram illustrating the exercise program.

The basic steps performed by the exercise system are illustrated in the flow diagram of FIG. 7. On initially turning on the system (step 120), all data files will be indexed (122) and the system lock valve 78 will be positively closed (124). An initial display of information will be provided on the screen 86 describing all of the various exercise options (step 26). Once a prospective user presses the start button (step 128) and deposits the necessary coin or token (steps 130, 132), if the machine is coin operated, the system lock valve will be opened (step 134). The screen display will then be controlled to ask various questions of the user in order to obtain the necessary statistical data (age, height, weight, sex) in step 136. This information will be stored and used subsequently both in the graphics display and in calculating various exercise parameters. The user is then invited to select any one of a series of preprogrammed exercise and other routines (step 138).

On initiation of an exercise routine, the user first selects whether they want to determine their fitness level, in which case they select the fitness test in which the computer determines their fitness against statistical data stored in its memory, or whether they simply want to exercise, or "compete against the machine". In the latter case, they can select one of a variety of different preprogrammed routines at different levels of difficulty, or may select manual mode where they set the pace themselves. Each programmed routine is controlled by the computer by setting the needle valve opening (step 140), and thus setting the resistance of the pedal to downward pushing by the operator and thus the pedal speed or pedal strokes per minute. Preferably, at least four different routines of varying difficulty are provided. The user can also opt to watch TV during exercise, with or without an informational display on their progress continuously displayed at the bottom of the screen. This information can be toggled on and off as often as desired by the user during the exercise routine. The display in the preferred embodiment described above also includes a cartoon figure generation in which a figure representing the user climbs a structure at a rate determined from data received from the pedal sensors, and another figure climbs at a rate determined by the selected program. The user can change the pace at any time during the routine via the speed adjustment keys 110.

When a user has selected the desired options and is ready to exercise, they simply press the start button (step 142). The computer controls size of the flow control valve opening according to the selected exercise program, where this option has been selected. Alternatively, this is controlled directly by the user via the speed adjustment keys 110. The computer also presets the timer according to the selected exercise routine, and starts the timer (step 144) as soon as the user presses the start button. The user then lets one foot go to the bottom and takes their weight off the other foot to allow that pedal to lift to the top of the stroke. They then start moving the pedals alternately up and down in a stair climbing type of action, taking all the weight off the rising pedal in each stroke. The pedals will move independently and let the user travel as fast as they can move their foot. The user will normally not depress the pedals to the full length of their stroke (typically around 14 inches), but will find a natural stroke length as they exercise, which will typically be around 7 to 9 inches. If the user finds that they cannot keep up with the pace set by the computer, they can change the pace to a faster speed with the speed control keys, increasing the control valve opening. If the user is outpacing the set rate, they adjust the speed in the opposite direction to reduce the pedal speed, reducing the valve opening.

While the user operates the pedals, the computer monitors the data from the various sensors 88, 90 (step 146), stores that data, and uses it along with the data previously collected to calculate various exercise parameters, such as the height climbed, rate of climb, calories burned, and so on (step 148). These parameters are displayed and stored (150). The calculated climb rate is used according to the selected program to control and move the figures on the graphical display to move at an equivalent rate (step 152). Various graphical images are stored by the computer in files and are used according to the user's data input and stored program instructions in writing to the screen. For example, various files contain background image information, male/-female figures, and ape figures. These files are used in order to generate the desired display, on the screen, with the continuously monitored sensor input being used to control the relative speeds of movement of the generated figures. Once the time expires (154), the exercise routine is ended (156) and the program is restarted.

The independently operating pedals of this machine provide a much more natural stair climbing action since the rising foot is not pushed up by depression of the descending foot. The pressure in the reservoir is set according to the size of the hydraulic cylinders to provide the desired resistance to pedal depression, similar to a spring action but much quieter and more natural than a mechanical system. In a typical example, a gas pressurized reservoir at a pressure of 55 p.s.i. was used. The hydraulic system is both quiet and reliable.

The computer control and monitoring system is easy to use and allows the user to monitor their progress continuously. The computer is programmed to store personal exercise information for each individual using the machine so that they can call up that information on subsequent routines and determine what progress they are making. The system also allows display of important information such as calories burned, pulse rate, and so on. The user can monitor their exercise routine while simultaneously watching a TV show or a videocassette, reducing the boredom factor inherent in repetitive exercise routines.

The provision of the heart or pulse rate monitor on the handle bars allows accurate tracking of heart rate without the need for inconvenient and unreliable ear lobe or chest monitors. Ear lobe and chest monitors have cords which can break or tangle, and also sometimes fall off or slip during exercising, resulting in a loss of data. The pressurized, sealed hydraulic system eliminates the notoriously unreliable and noisy springs, chains and cables of previous stair climbing machines.

Although a preferred embodiment of the invention has been described above by way of example only, it will be understood by those skilled in the field that modifications may be made to the disclosed embodiment without departing from the scope of the invention, which is defined by the appended claims.

We claim:

1. A stair climbing exercise machine, comprising:

an upright frame;

a pair of articulation, left and right foot pedals pivotally mounted on the frame for movement up and down between raised and lowered positions;

fluid-operated biassing means connected to each pedal for resisting downward movement of the pedal independent of movement of the other pedal and for biassing each lowered pedal to a raised position on removal of weight from that pedal; and said biassing means comprising a pair of piston and cylinder actuators connected to said respective pedals and moveable between extended and retracted positions to operate the pedals, a fluid-filled reservoir at a predetermined pressure, first and second connecting passages between said respective cylinder actuators and said reservoir, and a one-way valve in each connecting passage for allowing fluid flow in one direction only from the respective actuator to the reservoir.

2. The machine as claimed in claim 1, wherein said biassing means further includes return passageways from each actuator to said reservoir, a one-way valve in each return passageway allowing fluid flow in the return direction from the reservoir to the respective actuator.

3. The machine as claimed in claim 1, including a variable fluid flow control valve in the path from each actuator to the reservoir for controlling the pedal speed.

4. The machine as claimed in claim 3, including manual control means for controlling the size of said fluid flow control valve opening.

5. The machine as claimed in claim 1, including a system lock valve in the path from each actuator to the reservoir for locking the pedals on expiry of an exercise routine.

6. The machine as claimed in claim 1, including variable pedal rate control means for controlling a pedal rate.

7. The machine as claimed in claim 1, including sensor means for detecting the length of a pedal stroke.

8. The machine as claimed in claim 1, including parallelogram linkage means for pivotally mounting said pedals on said frame with said pedals orientated horizontally throughout their movement between said raised and lowered positions.

9. The machine as claimed in claim 8, wherein said frame includes a base comprising spaced side rods and upright sides each comprising spaced front and rear rods, and each parallelogram linkage means comprises spaced, parallel upper and lower arms, each upper arm being pivoted at one end on a respective one of said rear rods and at the opposite end on the forward end of the pedal on that side of the frame, and each lower arm being pivoted at one end on one of said base rods and at the opposite end at an intermediate position on the undersurface of said pedal on the same side of the frame.

10. The machine as claimed in claim 1, including handle bars for gripping by a user and a pulse rate monitor mounted in one of said handle bars for monitoring the user's heart rate.

11. The machine as claimed in claim 1, including a TV screen mounted on said frame at the approximate eye level of a user of the machine.

12. A stair climbing exercise machine, comprising:

an upright frame;

a pair of articulating left and right foot pedals pivotally mounted on the frame for movement between raised and lowered positions;

resistance means for opposing downward movement of one of the pedals independent of movement of the other one of the pedals and biassing each lowered pedal toward a raised position on removal of weight from that pedal, said resistance means comprising separate fluid-operated biassing actuators connected to each pedal, and variable flow control valve means for controlling fluid flow rate from said actuators to control the pedal rate;

detector means for detecting pedal stroke length;

control means for controlling operation of the stair climbing exercise machine according to a programmed routine selected by the user, the control means including means for controlling the time period of operation of the machine and for locking the machine at the end of a predetermined time period, means for controlling said flow control valve means to control the pedal rate, and means for monitoring the height climbed according to input from said detector means; and a TV display screen mounted on the frame and connected to said control means, said control means further including means for displaying a programmed display of exercise information on said TV screen, the display including information on the exercise rate.

13. A stair climbing exercise machine, comprising:

an upright frame;

a pair of articulating left and right foot pedals pivotally mounted on the frame for movement between raised and lowered positions;

a pair of fluid-operated piston and cylinder actuators, each actuator being connected to a respective one of said foot pedals for resisting downward movement of the respective pedal independent of movement of the other pedal and biassing the pedal towards the raised position on removal of an operator's weight from that pedal, a fluid communication circuit connected to said actuators and a fluid-filled reservoir, said circuit including variable valve means having a variable valve opening for controlling the fluid flow rate from each of said actuators and said reservoir to control the pedal speed;

control means connected to said variable valve means for controlling the size of the valve opening;

operator input means connected to said control means for operator input of data including the operator's weight; and said control means including means for setting the valve opening in response to the data input by the operator.

* * * * *